US008474113B2

(12) United States Patent
Badrenas Buscart

(10) Patent No.: US 8,474,113 B2
(45) Date of Patent: Jul. 2, 2013

(54) BUCKLE ASSEMBLY

(75) Inventor: Jordi Badrenas Buscart, Barcelona (ES)

(73) Assignee: Illinois Tool Works, Inc., Glenview, IL (US)

( * ) Notice: Subject to any disclaimer, the term of this patent is extended or adjusted under 35 U.S.C. 154(b) by 923 days.

(21) Appl. No.: 12/527,279

(22) PCT Filed: Feb. 19, 2007

(86) PCT No.: PCT/EP2007/051579

§ 371 (c)(1),
(2), (4) Date: Oct. 4, 2009

(87) PCT Pub. No.: WO2008/101543

PCT Pub. Date: Aug. 28, 2008

(65) Prior Publication Data

US 2010/0011542 A1 Jan. 21, 2010

(51) Int. Cl.
*A44B 11/26* (2006.01)

(52) U.S. Cl.
USPC ..... 24/634; 24/633; 24/593.11; 24/DIG. 48

(58) Field of Classification Search
USPC ..... 24/629, 633, 634, 640, 591.1, 593.1, 24/593.3, 194, 196, DIG. 48
See application file for complete search history.

(56) References Cited

U.S. PATENT DOCUMENTS

| | | | | |
|---|---|---|---|---|
| 1,786,943 | A * | 12/1930 | Gammell | 24/574.1 |
| 4,400,857 | A * | 8/1983 | Morinaga | 24/633 |
| 4,490,892 | A * | 1/1985 | Ueda | 24/640 |
| 4,844,214 | A | 7/1989 | Castelli et al. | |
| 4,916,779 | A | 4/1990 | Terada et al. | |
| 5,490,685 | A * | 2/1996 | Kitayama et al. | 24/579.09 |
| 6,108,821 | A | 8/2000 | Malsoute | |
| 7,089,603 | B2 * | 8/2006 | Ketterer et al. | 2/418 |

FOREIGN PATENT DOCUMENTS

| | | | |
|---|---|---|---|
| DE | 10110030 | A1 | 9/2002 |
| DE | 202005013696 | U1 | 12/2005 |
| EP | 0345014 | A2 | 12/1989 |
| FR | 2778068 | A1 | 11/1999 |

OTHER PUBLICATIONS

ISR for PCT/EP2007/051579 mailed Nov. 16, 2007.

* cited by examiner

*Primary Examiner* — Robert J Sandy
(74) *Attorney, Agent, or Firm* — Lowe Hauptman Ham & Berner, LLP

(57) ABSTRACT

A side-release buckle assembly includes a main housing, a button positioned through a side of the main housing, a metal coil spring biased between an interior wall of the main housing and the button, and a mating member. Movement of the button is directly transferred to the spring, and vice versa. The ratchet strap is moveable through the main housing in a first direction, and when the button is pressed, the ratchet strap is moveable through the buckle housing in a second direction opposite to the first direction.

20 Claims, 6 Drawing Sheets

BUCKLE ASSEMBLY

RELATED APPLICATIONS

The present application is based on, and claims priority from, International Application Number PCT/EP2007/051579 filed Feb. 19, 2007, the disclosure of which is hereby incorporated by reference herein in its entirety.

FIELD OF THE INVENTION

Embodiments of the present invention generally relate to a buckle assembly, and more particularly, to a side-release buckle assembly that may be used with helmets, backpacks, and the like.

BACKGROUND OF THE INVENTION

Buckle assemblies are used in various applications. Various helmets, such as bicycle helmets, utilize buckle assemblies to ensure a secure and proper fit with respect to a wearer's head. Typically, each buckle assembly includes a male buckle housing that is configured to mate with a female buckle housing. Each buckle member is connected to a separate web or strap that a wearer can adjust.

Some buckle assemblies include ratchet members that allow a wearer to adjust the helmet straps for a more comfortable fit. The wearer typically adjusts the web or strap for a large adjustment, while the wearer engages the ratchet member for a finer adjustment.

One such type of ratchet buckle is a top-release ratchet buckle assembly. That is, the engagement button for the ratchet member is located on top of one of the buckle housings. Top-release ratchet buckle assemblies are typically bulky. Moreover, pushing a button towards a wearer's face, as one does with a top-release ratchet buckle assembly, is not natural, and may prove uncomfortable for a wearer. Additionally, because the engagement button is exposed on the top side of the assembly, the engagement button is susceptible to inadvertent engagement by the user, or an object. As such, the button may be accidentally engaged, thereby inadvertently releasing the buckle.

To overcome the drawbacks of top-release ratchet buckle assemblies, side-release ratchet buckle assemblies were developed. A typical side-release ratchet buckle includes two parts: a ratchet strap and a buckle housing. The buckle housing has an integrally formed button. Typically, the button is integrally connected to a plastic spring within the buckle housing that compresses the button into the ratchet strap to lock the ratchet strap within the buckle housing. In order to disengage the ratchet strap, the button is engaged, which then disengages the ratchet strap. After the button is released, the plastic spring forces the button back into a locking relationship with the ratchet strap.

While the two piece design of the side-release ratchet buckle assembly is efficient to manufacture, the plastic spring is susceptible to cold-flowing if it is left in the flex position. That is, changes in pressure and temperature may warp the plastic spring, thereby reducing its ability to function properly. Cold-flowing may occur if the buckle is not latched all the way together, thereby forcing the plastic spring into a stressed position.

Additionally, it has been found that the conventional side-release ratchet buckle assembly does not operate smoothly and easily. The spring force direction within the assembly is angled within the buckle housing. Motion from the button is not directly transferred to the spring, and vice versa. That is, movement of the button in one direction causes the spring to move in a direction that is angled with respect to the movement of the button, and vice versa. Thus, when a wearer engages the button, the button, in turn, exerts an angled force into the button, thereby wasting movement and energy.

Thus, a need exists for a more efficient side-release buckle assembly. A need exists for a buckle assembly that is not susceptible to cold flowing. A need also exists for a buckle assembly that operates smoothly and easily with little wasted motion or energy.

SUMMARY OF THE INVENTION

Certain embodiments of the present invention provide a buckle assembly that includes a main buckle housing, a button, a metal coil spring, and a ratchet strap.

The main housing may include a base integrally formed with first and second lateral walls, which are in turn integrally formed with a top wall. A strap passage is formed through a length of the main housing and a button passage is formed through the first lateral wall.

The button may include an engagement wall connected to a locking shelf and a spring securing member, such as a flat wall portion into which a portion of the spring is biased, a post, clasp, barb, recessed area, or the like. The button is received and retained in the main housing through the button passage. The locking shelf may include two spaced-apart latches.

The metal coil spring includes a first end secured to the spring securing member and a second end biased into an interior of the second lateral wall. The spring exerts equal and opposite forces into the button and the main housing. Movement of the button is directly transferred to the spring, and vice versa. That is, linear movement of the button in one direction directly and linearly compresses the spring in that direction, while linear decompression of the spring in the opposite direction directly moves the button in the same linear direction.

The ratchet strap may include two tracks of teeth spaced apart from one another by a gap. The ratchet strap is positioned within the strap passage. The ratchet strap is moveable through the strap passage in a first direction, and when the button is pressed, the ratchet strap is moveable through the ratchet strap in a second direction, which is opposite of the first direction.

The two tracks of teeth are configured to move over the latches in the first direction and prevented from retreating in the second direction unless the button is pressed. Each of the latches may include a securing wall, and each of the teeth may include a ramped surface integrally formed with a securing edge, such as a straight edge. The ramped surfaces slide over the latches in the first direction, and the teeth are blocked from moving in the second direction by the straight edges abutting the securing walls. The ratchet strap is allowed to move in the second direction when the button is pressed, thereby moving the straight edges out of an abutting relationship with the securing walls.

The button may also include a first ledge, and the main housing may also include a second ledge. The button is prevented from ejecting from the main housing by the first ledge abutting the second ledge.

Additionally, the main housing may include a first web engagement member configured to retain a first fabric web, and the ratchet strap may also include a second web engagement member configured to retain a second fabric web.

Certain embodiments of the present invention provide a buckle assembly that may include a main housing, a button, a metal coil spring, and a ratchet strap. The button is positioned through a side of the main housing. The metal coil spring is biased between an interior wall of the main housing and the button, wherein movement of the button is directly transferred to the spring, and vice versa. The ratchet strap is moveable through the main housing in a first direction, and when the button is pressed, the ratchet strap is moveable through the main housing in a second direction, which is opposite of the first direction.

Certain embodiments of the present invention provide a side-release buckle assembly that may include a main housing, a button, a metal coil spring, and a mating member, such as a ratchet strap or a male buckle housing.

The main housing may include a base integrally formed with first and second lateral walls, which are in turn integrally formed with a top wall. A mating passage is formed through at least a portion of the main housing and a button passage is formed through the first lateral wall.

The button may include an engagement wall connected to a locking shelf and a spring securing member. The button is received in the main housing through the button passage. The locking shelf may include first and second latches spaced apart from one another.

The metal coil spring may include a first end secured to the spring securing member and a second end biased into an interior of the second lateral wall. The spring exerts equal and opposite forces into the button and the main housing, and movement of the button is directly transferred to the spring, and vice versa.

The mating member may include a first row of securing teeth including first and second teeth spaced apart from one another by a gap. The mating member is positioned within the mating passage. The mating member is secured to the button by the first and second teeth securely mating with the first and second latches, respectively. Movement of the button into the main housing dislodges the first and second teeth from the first and second latches, respectively, in order to disconnect the mating member from the main housing.

Figure 1:
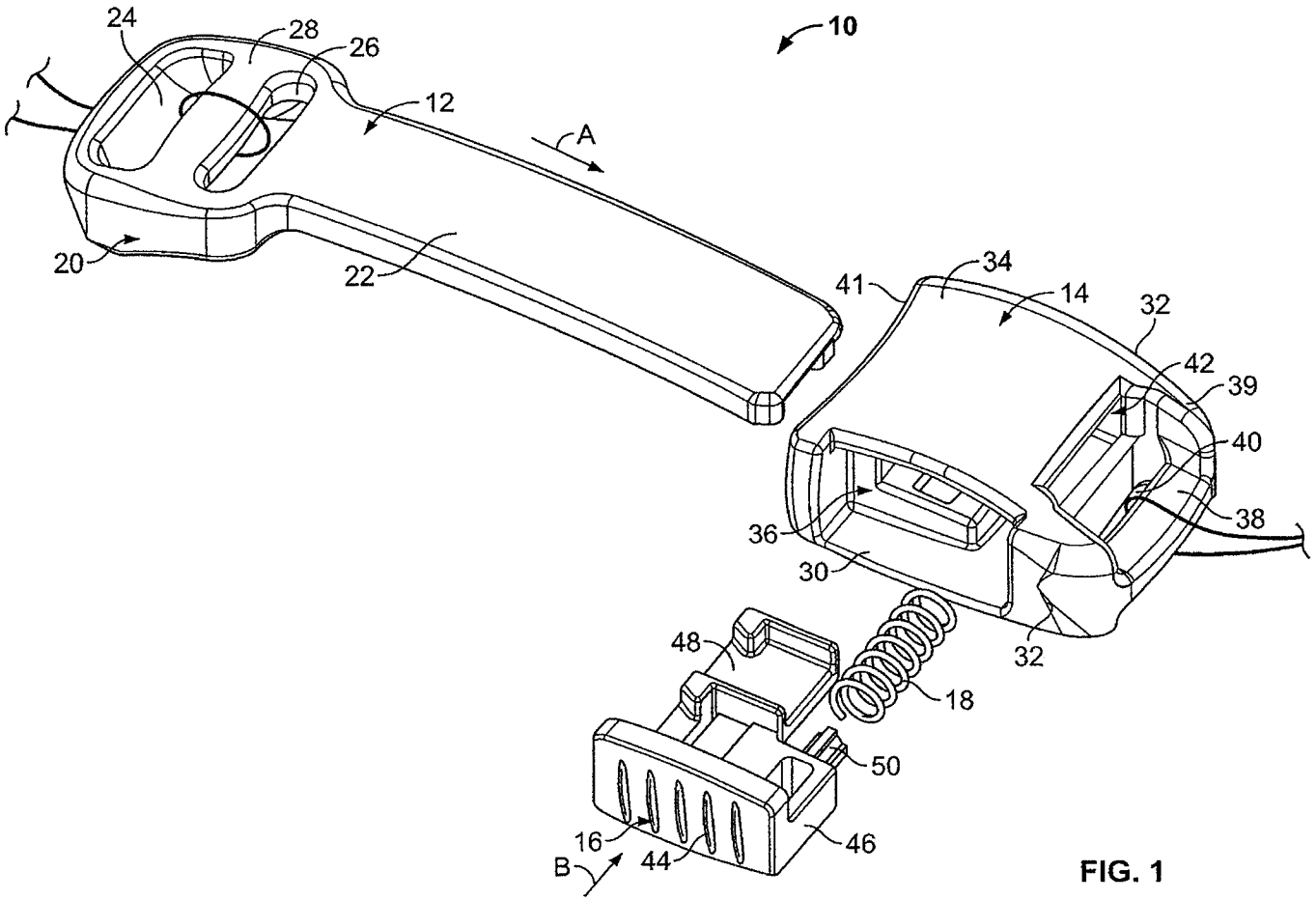
FIG. 1 illustrates an isometric exploded top view of a ratchet buckle assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates an isometric exploded top view of a ratchet buckle assembly 10 according to an embodiment of the present invention. As shown in FIG. 1, the assembly 10 is a side-release ratchet buckle assembly. The assembly 10 includes a mating member, such as a ratchet strap 12 (or buckle member) and a buckle housing 14 having a button 16 and a spring 18 secured therein. As shown in FIG. 1, the button 16 and the spring 18 are separate and distinct components and are both separately manufactured from the button 16. The spring 18 is a metal coil spring having a particular force constant.

The ratchet strap 12 includes a web engagement head 20 integrally formed with an extension beam 22. The web engagement head 20 includes two passages 24 and 26 separated by a crossbeam 28. A web of material, such as a fabric strap, is secured to the web engagement head 20 through the passages 24, 26 and the crossbeam 28. The web of material may be adjusted with respect to the web engagement head 20.

The buckle housing 14 includes a base 30 integrally formed with side walls 32, which are in turn integrally formed with a top wall 34. A button passage 36 is formed through one of the side walls 32 and is configured to receive the button 16 and the spring 18. A web engagement member 38 is formed at one end 39 of the buckle housing 14. The web engagement member 38 includes at least one web passage 40. A web of material, such as a fabric strap, is secured to the web engagement member 38. The web of material may be adjusted with respect to the web engagement member 38. The web engagement member 38 may be the same as the web engagement head 20, or vice versa.

A strap passage 42 is formed underneath the top wall 34 above the web engagement member 38. The strap passage 42 is configured to allow the extension strap 22 of the ratchet strap 12 to pass therethrough. The strap passage 42 passes from the end 39 of the buckle housing 14 to the other end 41. In order to secure the ratchet strap 12 to the buckle housing 14, the extension strap 22 is urged into the strap passage 42 in the direction of arrow A.

The button 16 includes an engagement wall 44 integrally formed with a base 46. The base 46 is, in turn, integrally formed with a ratchet locking shelf 48 and a spring post 50. One end of the spring 18 is positioned around the spring post 50 and abuts the base 46. The other end of the spring 18 abuts an internal wall (not shown) of the buckle housing 14. Thus, the spring 18 exerts forces into both the internal wall of the buckle housing 14 and the button 16. The button 16 and the spring 18 are installed into the button housing 14 in the direction of B, as further explained with respect to FIGS. 4-6.

As shown in FIG. 1, the spring 18 exerts forces into the button 16 and the buckle housing 14 that are parallel to the direction of button engagement (i.e., arrow B). For example, when the button 16 is pressed in the direction of arrow B, the spring is compressed in the same direction. As such, force is directly transferred from the button 16 into the metal spring 18, thereby providing a direct and immediate locking or unlocking response (which is in contrast to the prior art side-release assembly that includes a plastic spring that is angled with respect to the button). Additionally, because the spring 18 is metal, it is not susceptible to cold-flowing (as are prior art integrally formed plastic springs).

Figure 2:
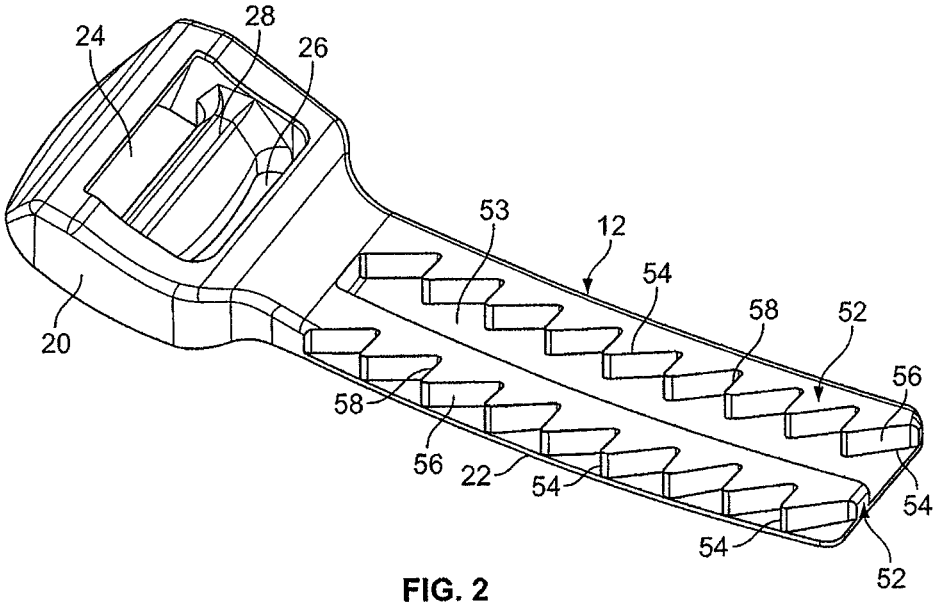
FIG. 2 illustrates a bottom isometric view of a ratchet strap according to an embodiment of the present invention.

FIG. 2 illustrates a bottom isometric view of the ratchet strap 12. The underside of the extension beam 22 includes two parallel sawtooth tracks 52 spaced apart from one another by a gap 53. Each track 52 includes a plurality of longitudinally spaced teeth 54. The two tracks together 52 form a series of rows of teeth 54. Each tooth 54 includes a ramped surface 56 integrally formed with an abrupt straight edge 58. The sawtooth tracks 52 are configured to securely mate to the ratchet locking shelf 48 of the button 16 (shown in FIG. 1). The ratchet strap 12 may have more or less sets of teeth 54 than those shown in FIG. 2. Additionally, more or less toothed tracks 52 may be used than those shown. However, it has been found that multiple tracks 52 provide greater strength and reliability than just one track. Two tracks 52, for example, provide greater strength and stability than only one track, and the two track arrangement is less susceptible to breaking or snapping than a single track or tooth arrangement.

While the tracks 52 are shown as sawtooth tracks, the tracks may alternatively include various features configured to securely engage counterpart structures. For example, the tracks 52 may include rectangular, semi-circular, or various other shaped protuberances, barbs, clasps, or the like.

Figure 3:
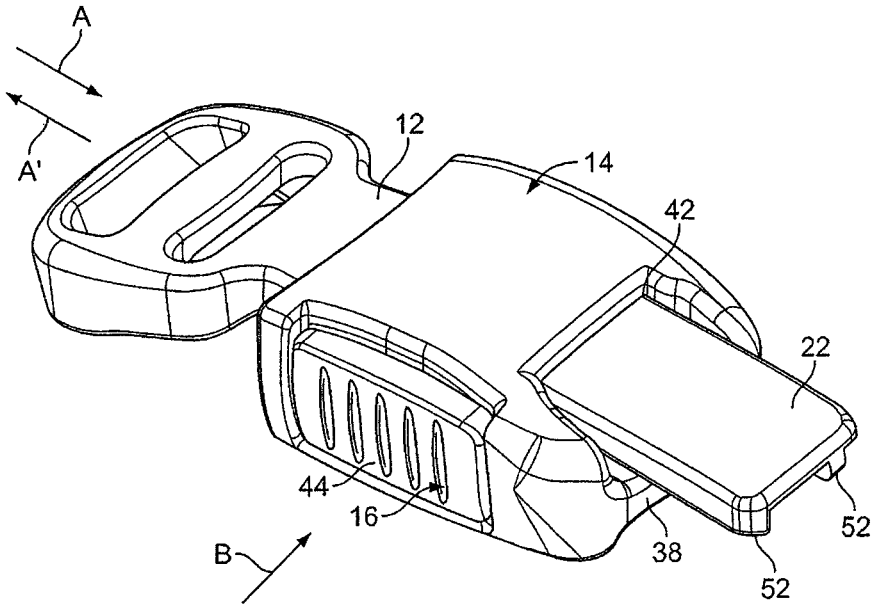
FIG. 3 illustrates an isometric top view of a ratchet buckle assembly according to an embodiment of the present invention.

FIG. 3 illustrates an isometric top view of the ratchet buckle assembly 10. As shown in FIG. 3, the extension beam 22 of the ratchet strap 12 is positioned through the strap passage 42. The distal end of the ratchet strap 12 is positioned over the web engagement member 38. In order to adjust the ratchet strap 12 with respect to the buckle housing 14, the engagement wall 44 of the button 16 is pressed in the direction of arrow B. In this position, the ratchet locking shelf 48 (shown in FIG. 1) unlocks from the toothed tracks 52 (shown in FIG. 2) of the ratchet strap 12. Thus, the ratchet strap 12 may be adjusted in the directions of A and A'. When the button 16 is no longer pressed in the direction of arrow B, the spring 18 (shown in FIG. 1) forces the button 16 back to its disengaged position, and the ratchet locking shelf 48 securely locks onto another set of teeth 54 (shown in FIG. 2) of the sawtooth tracks 52.

Figure 4:
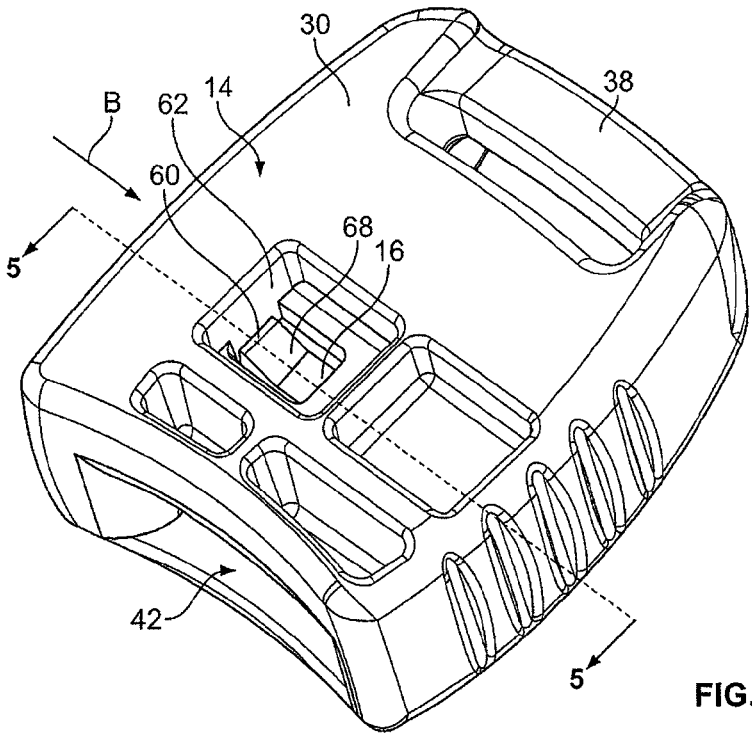
FIG. 4 illustrates an isometric bottom view of a buckle housing according to an embodiment of the present invention.

FIG. 4 illustrates an isometric bottom view of the buckle housing 14. The button 16 includes a ledge 60 that abuts a ledge 62 formed in the base 30 of the buckle housing 14. The abutment of the ledges 60 and 62 ensures that the button 16 remains securely retained by the button housing 14.

Figure 5:
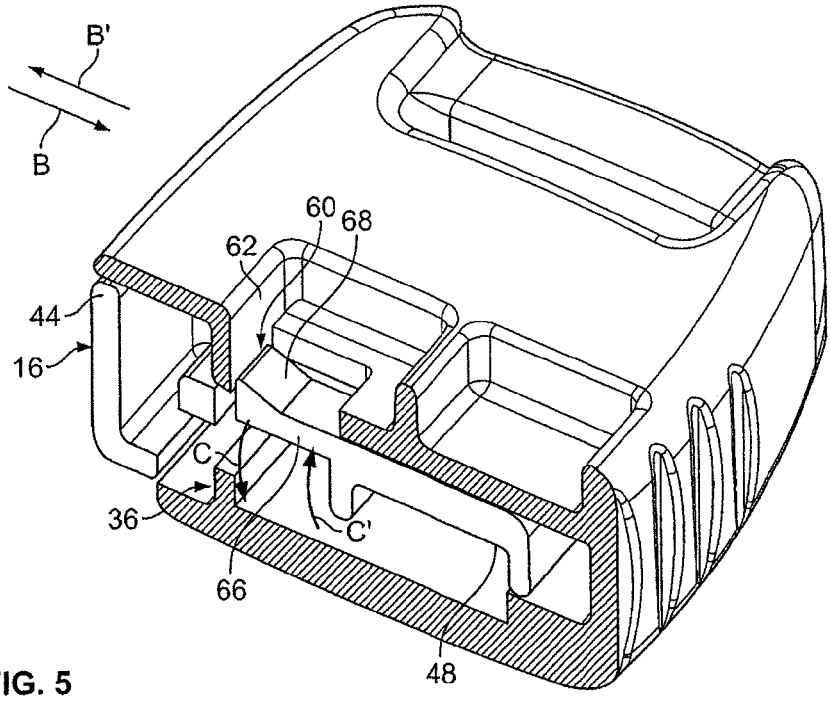
FIG. 5 illustrates an isometric cross-sectional view of a buckle housing through line 5-5 of FIG. 4 according to an embodiment of the present invention.

FIG. 5 illustrates an isometric cross-sectional view of the buckle housing 14 through line 5-5 of FIG. 4. Referring to FIGS. 1, 4, and 5, in order to secure the button 16 to the buckle housing 14, the ratchet locking shelf 48 and the spring post 50, with the spring 18 positioned around the post 50, are moved into the buckle housing 14 through the button passage 36 in the direction of arrow A. As the button 16 moves into the buckle housing 14, a flexible beam 66 connected to the underside of the ratchet locking shelf 48 engages a top surface of the ledge 62 of the buckle housing 14. The ledge 60 extends downwardly from the beam 66 and tapers toward the ratchet locking shelf 48 through a ramped surface 68. As the button 16 moves into the buckle housing 14, the ledge 62 engages the ramped surface 68, and thereby forces the beam 66 to flex in the direction of arrow C. With continued movement of the button 16 in the direction of arrow B, the ramped surface 68 slides over the top surface of the ledge 62 and the beam 66 continues to flex in the direction of arrow C until the ledge 62 encounters the ledge 60 formed on the beam 66. Once the ledge 62 encounters the ledge 60, the beam 66 snaps down in the direction of arrow C', and the ledges 60 and 62 snap into an abutting relationship. The abutting relationship between the ledges 60 and 62 prevents the button 16 from ejecting out of the buckle housing 14. As such, the button 16 is secured within the buckle housing 14.

When the engagement wall 44 of the button 16 is further pressed in the direction of arrow B, the ledge 60 moves away from the ledge 62 in the direction of arrow B. However, the force exerted by the spring 18 moves the button 16 back in the direction of arrow B' when the button 16 is no longer pressed. The button 16 is prevented from ejecting from the buckle housing 14 by the ledge 60 moving back into an abutting relationship with the ledge 62.

Figure 6:
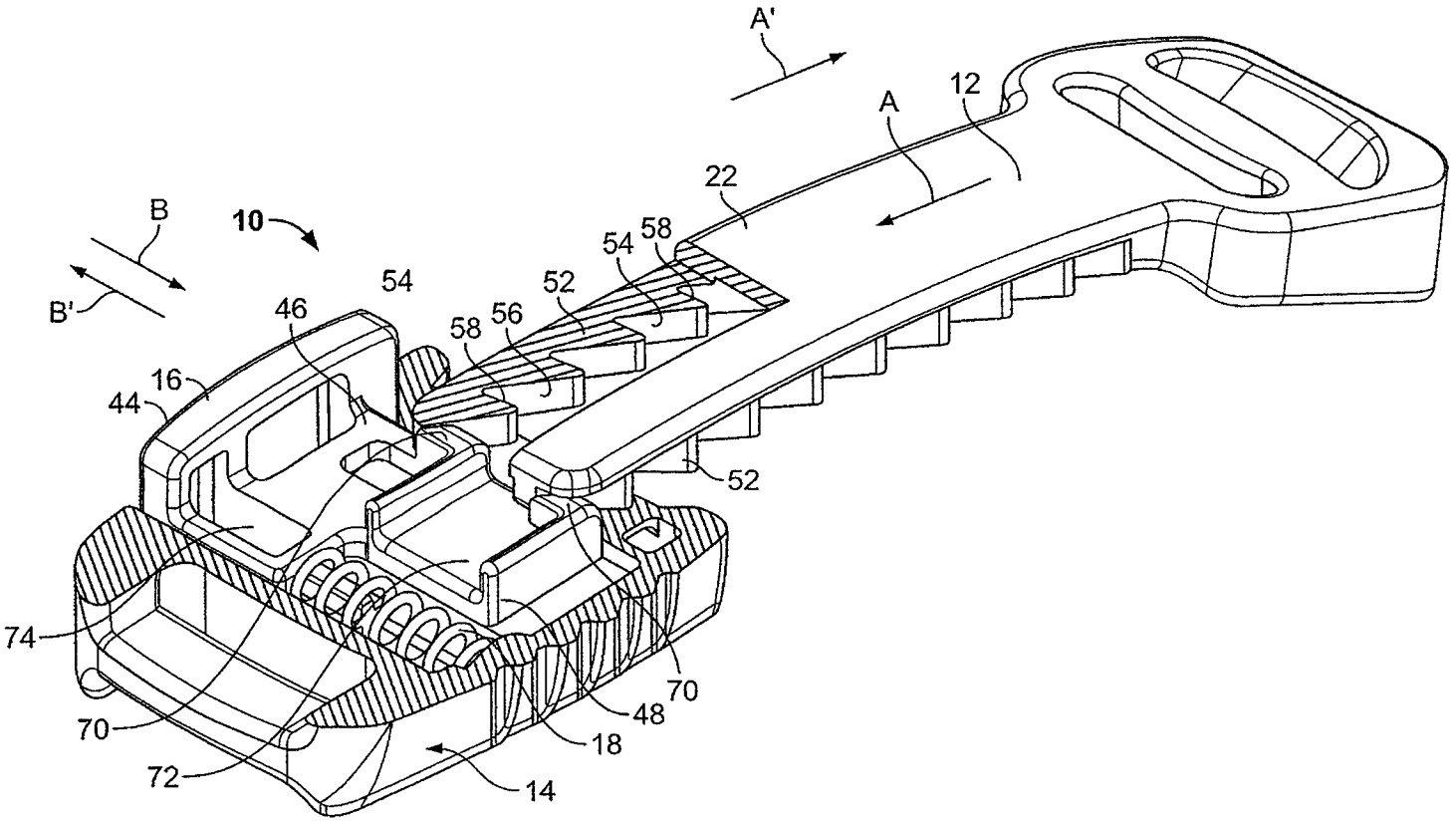
FIG. 6 illustrates an isometric internal cut-away view of a ratchet buckle assembly in an initial mating position according to an embodiment of the present invention.

FIG. 6 illustrates an isometric internal cut-away view of the ratchet buckle assembly 10 in an initial mating position. In this position, the distal end of the extension beam 22 passes into the strap passage 42 (shown, e.g., in FIG. 4) of the buckle housing. The ratchet locking shelf 48 includes two latching members 70 separated by a gap 72. The latching members 70 may be teeth, barbs, clasps, or the like configured to securely lock onto the teeth 54 of the sawtooth tracks 52. In the initial mating position, one sawtooth track 52 is aligned with the gap 72 while the other sawtooth track 52 is aligned with a clearance area 74 located over the base 46.

Figure 7:
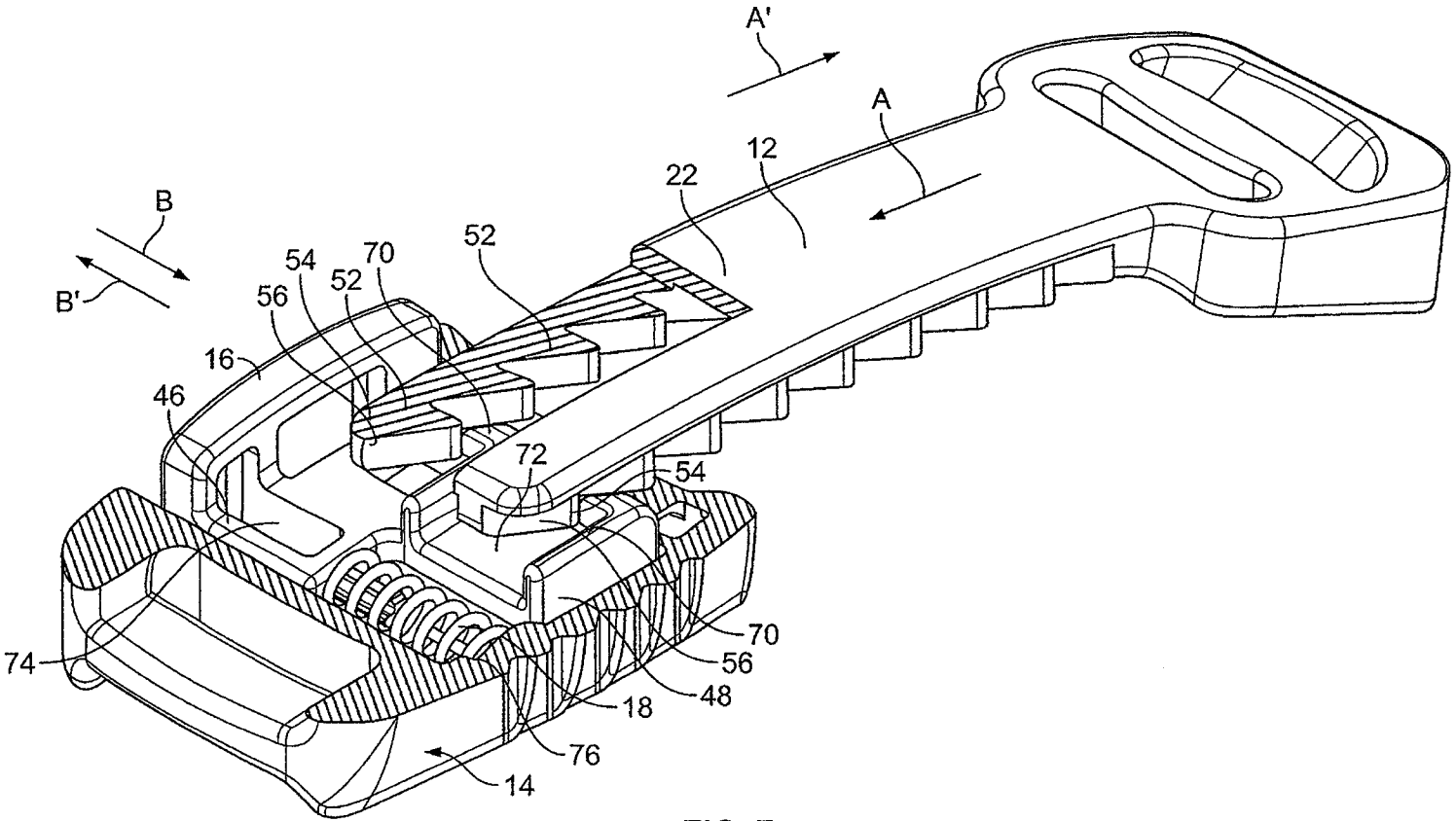
FIG. 7 illustrates an isometric internal cut-away view of a ratchet buckle assembly in a continued mating position according to an embodiment of the present invention.

FIG. 7 illustrates an isometric internal cut-away view of the ratchet buckle assembly 10 in a continued mating position according to an embodiment of the present invention. In this position, one track 52 is in the gap 72 while the other track 52 is in the clearance area 74. As the ratchet strap 12 moves into the buckle housing 14 in the direction of arrow A, the distal teeth 54 move over the latching members 70 (i.e., the ramped surfaces 56 slide over the latching members 70), forcing the ratchet locking shelf 48, and therefore the button 16 to move in the direction of arrow B. During this movement, the spring 18 compresses between the base 46 of the button 16 and an internal wall 76 of the buckle housing 14.

Figure 8:
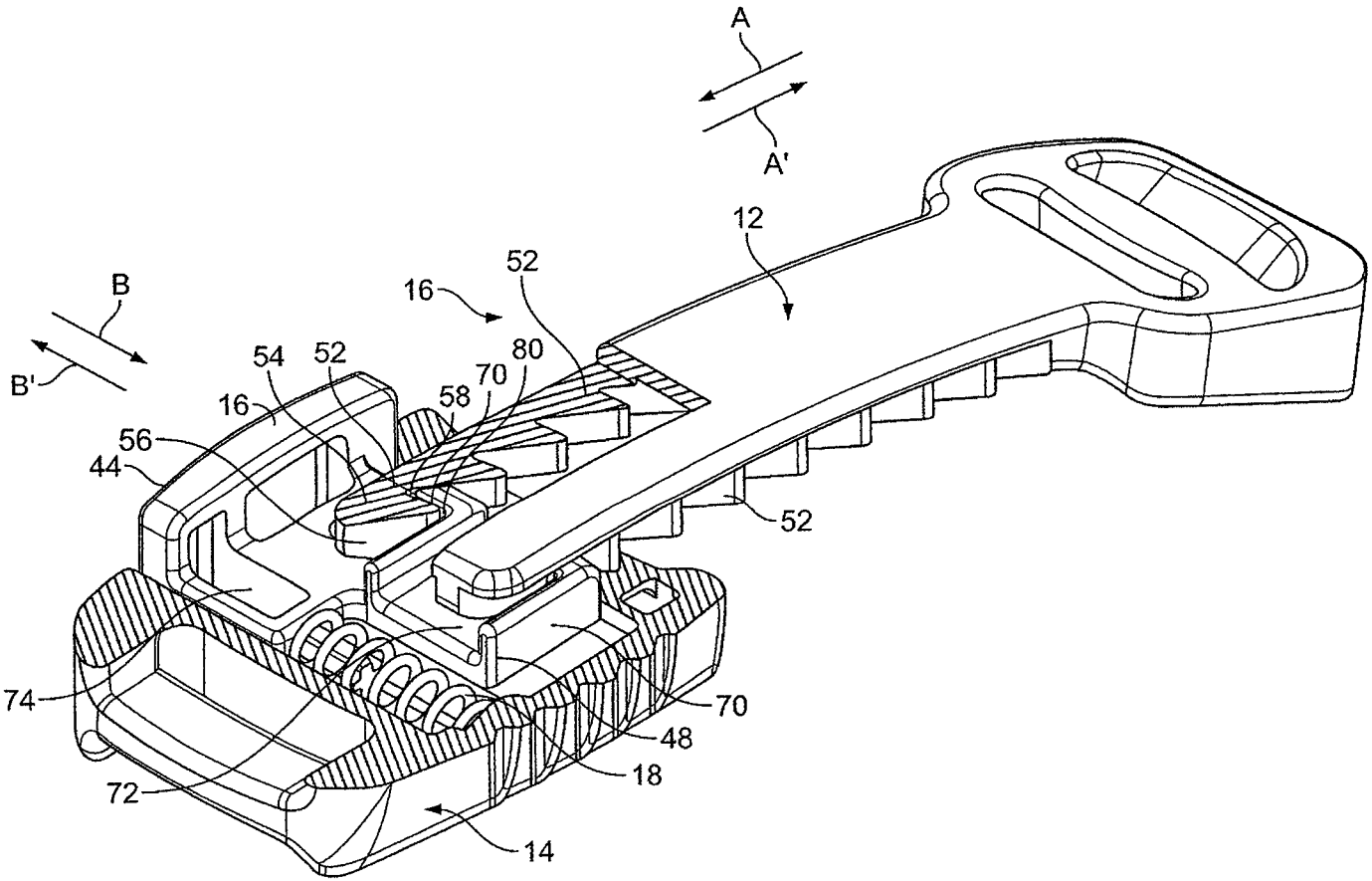
FIG. 8 illustrates an isometric internal cut-away view of a ratchet buckle assembly in a secure mated position according to an embodiment of the present invention.

FIG. 8 illustrates an isometric internal cut-away view of the ratchet buckle assembly 10 in a secure mated position according to an embodiment of the present invention. The teeth 54 continue to slide over the latching members 70, and inwardly force the button 16 in the direction of arrow B, until the straight edges 58 of the teeth encounter straight interior walls 80 of the latching members 70. When the straight edges 58 of the teeth 54 encounter the walls 80, the force stored in the spring 18 is released, thereby forcing the ratchet locking shelf 48 back in the direction of arrow B'. As such, the straight edges 58 of the teeth 54 securely abut the wails 80 of the latching members 70, thereby securing the ratchet strap 12 to the button 16 of the buckle housing 14.

In order to adjust the ratchet strap 12 within the buckle housing 14 in the direction of arrow A', the engagement wall 44 of the button 16 is pressed in the direction of arrow B. Consequently, the ratchet locking shelf 48 moves into the buckle housing 14 in the direction of arrow B, and the wails 80 of the latching members 70 lose contact with the straight edges 58 of the teeth 54. Thus, the ratchet strap 12 is no longer securely locked to the button 16. A user may then pull the ratchet strap 12 through the buckle housing 14 in the direction of arrow A'.

Because the ratchet strap 12 includes the sawtooth tracks 52, the ratchet strap 12 may be moved into the buckle housing 14 in the direction of arrow A without pressing the button 16. Instead, the ramped surfaces 56 of the teeth 54 slide over the latching members 70, thereby forcing the ratchet locking shelf 48 in the direction of arrow B, and compressing the spring 18 as each set of teeth 54 pass over the latching members 70. However, as one set of teeth 54 moves over the latching members 70 in the direction of arrow A, the spring 18 forces the button 16 back in the direction of arrow B', thereby snapably moving the straight edges 58 of the teeth 54 into a locking abutment with the walls 80 of the latching members 70. This movement may emit a clicking sound as each set of teeth 54 securely engages the latching members 70. The abutment of the walls 80 of the latching members 70 and straight edges 58 of each set of teeth 54 prevents the ratchet strap 12 from retreating in the direction of arrow A', unless the button 16 is pushed in the direction of arrow B. Engagement of the button 16 in the direction of arrow B, however, dislodges the teeth 54 from the latching members 70. In this way, the ratchet strap 12 may be adjusted in the directions of A and A' to provide a tighter or looser fit. The ratchet strap 12 secures to the button 16 of the buckle housing 14 such that it may be urged in the direction of arrow A without pressing the button 16, but, retreats in the direction of arrow A' only when the button 16 is pressed in the direction of arrow B.

As shown in FIGS. 6-8, for example, movement of the button 16 is directly translated to the spring 18. That is, the linear movement of the button 16 and the linear compression/decompression of the spring 18 is the same direction. For example, movement of the button 16 in the direction of arrow B causes the spring 18 to compress in a direction that is parallel to the movement of the button 16. No movement is wasted between the button 16 and the spring 18. As such, a user who pushes the button 16 to unlock the ratchet strap 12 from the ratchet locking shelf 48 of the button 16 is provided a smooth and immediate unlocking response. Similarly, when the button 16 is disengaged, the spring 18 decompresses to its at-rest position in the direction of arrow B', thereby smoothly and immediately moving the button 16 back to its original position in which the latching members 70 securely engage a set of teeth 54.

The same locking movement between the teeth 54 and latching members 70 may be used in a buckle assembly that does not include a ratchet strap. For example, instead of a ratchet strap, the buckle assembly 10 may include a mating member such as a male buckle housing having one set of teeth extending outwardly therefrom. The teeth are configured to engage the latching members 70. In order to connect the male housing to the buckle housing 14, the teeth of the male housing are urged into the strap passage 42 and lock onto the latching members 70 as described above. In order to disconnect, the button 16 is pushed, thereby disengaging the teeth 54 from the latching members 70, as described above, and the male housing may be removed from the buckle housing 14.

Thus, embodiments of the present invention provide a more efficient and easy-to-use side-release buckle assembly. Embodiments of the present invention, which may be used as a buckle for a chin strap on a helmet, provide a side-release buckle assembly that is less susceptible to inadvertent disengagement as compared to top-release buckle assemblies. Additionally, embodiments of the present invention provide a natural, side release buckle assembly in which a user pushes a button on a side of the housing toward a center of the housing. Further, movement between the spring within the buckle housing and the button is direct, smooth, and immediate. Additionally, because the spring is metal, it is not susceptible to cold-flowing as compared to plastic spring members.

While various spatial terms, such as front, rear, upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that a front portion is a rear portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A buckle assembly, comprising:

a main housing comprising:

first and second lateral walls; and a top wall integrally formed with the first and second lateral walls, wherein a strap passage is formed through said main housing and a button passage is formed through said first lateral wall;

a button received in said main housing through said button passage;

a spring configured to exert equal and opposite forces into said button and said main housing, wherein movement of said button is configured to be directly transferred to said spring, and vice versa; and a ratchet strap positioned within said strap passage, wherein said ratchet strap is moveable through said strap passage in a first direction, and when said button is pressed, said ratchet strap is moveable through said main housing in a second direction opposite to the first direction, wherein said button further comprises a first ledge, and said main housing further comprises a second ledge, wherein said button is prevented from ejecting out of said main housing by said first ledge abutting said second ledge, and wherein the top wall of the housing includes a recess connected with the button passage, the recess exposes a top portion of the button when the button is released, and a closed end of the recess is configured to define a stop for a finger operating the button in use.

2. The buckle assembly of claim 1, wherein the spring is a metal coil spring.

3. The buckle assembly of claim 1, wherein the button further comprises a locking shelf including two spaced-apart latches;

a spring securing member; and an engagement wall connected to the locking shelf and the spring securing member.

4. The buckle assembly of claim 3, wherein the ratchet strap comprises two tracks of teeth spaced apart from one another by a gap, and said two tracks of teeth are configured to move over said latches in the first direction and prevented from retreating in the second direction unless said button is pressed.

5. The buckle assembly of claim 4, wherein each of said latches comprises a securing wall, and each of said teeth comprises a ramped surface integrally formed with a securing edge.

6. The buckle assembly of claim 5, wherein said ramped surfaces are configured to slide over said latches in the first direction, wherein said teeth are blocked from moving in the second direction by said securing edges abutting said securing walls, and wherein said ratchet strap is allowed to move in the second direction when said securing edges are moved out of an abutting relationship with said securing walls.

7. The buckle assembly of claim 6, wherein said securing edges are configured to be moved out of an abutting relationship with said securing walls when said button is pressed.

8. The buckle assembly of claim 1, wherein said main housing further comprises a first web engagement member configured to retain a first web defining a first strap, and wherein said ratchet strap further comprises a second web engagement member configured to retain a second web defining a second strap.

9. A buckle assembly, comprising:

a main housing;

a button positioned through a side of said main housing;

a spring biased between an interior wall of said main housing and said button, wherein movement of said button is arranged to be directly transferred to said spring, and vice versa; and a ratchet strap moveable through said main housing in a first direction, wherein, when said button is pressed, said ratchet strap is movable through said main housing in a second direction opposite to the first direction, and when said button is released, an entirety of said button remains secured within said main housing.

10. The buckle assembly of claim 9, wherein said ratchet strap further comprises two tracks of teeth, and said main housing comprises latches, and wherein said two tracks of teeth are configured to move over said latches in the first direction and prevented from retreating in the second direction unless said button is pressed.

11. The buckle assembly of claim 10, wherein each of said latches comprises a securing wall, and each of said teeth comprises a ramped surface integrally formed with a straight edge.

12. The buckle assembly of claim 11, wherein said ramped surfaces slide over said latches in the first direction, and wherein said teeth are blocked from moving in the second direction by said straight edges abutting said securing walls.

13. The buckle assembly of claim 12, wherein said straight edges are moved out of an abutting relationship with said securing walls when said button is pressed, and wherein said ratchet strap is allowed to move in the second direction when said straight edges are moved out of an abutting relationship with said securing walls.

14. The buckle assembly of claim 9, wherein said button further comprises a first ledge, and said main housing further comprises a second ledge, and wherein said button is prevented from ejecting from said main housing by said first ledge abutting said second ledge.

15. The buckle assembly of claim 9, wherein said main housing further comprises a first web engagement member configured to retain a first web, and wherein said ratchet strap further comprises a second web engagement member configured to retain a second web.

16. The buckle assembly of claim 9, wherein the spring is a metal coil spring.

17. A side-release buckle assembly, comprising:

a main housing comprising:

first and second lateral walls;

a base integrally formed with first and second lateral walls; and a top wall integrally formed with the first and second lateral walls, wherein a mating passage is formed through at least a portion of said main housing and a button passage is formed through said first lateral wall;

a button comprising:

a locking shelf including first and second latches;

a spring securing member; and an engagement wall connected to the locking shelf and the spring securing member, wherein said button is received in said main housing through said button passage;

a coil spring comprising a first end secured to said spring securing member and a second end biased into an interior of said second lateral wall, wherein said spring is configured to exert equal and opposite forces into said button and said main housing, wherein movement of said button is configured to be directly transferred to said spring, and vice versa; and a mating member comprising a first row of securing teeth comprising first and second teeth spaced apart from one another by a gap, said mating member being positioned within said mating passage, wherein said mating member is secured to said button by said first and second teeth securely mating with said first and second latches, respectively, wherein movement of said button into said main housing dislodges said first and second teeth from said first and second latches, respectively, in order to disconnect said mating member from said main housing, and wherein, when said button is released, said button remains retained within said main housing without projecting beyond said first lateral wall.

18. The side-release buckle assembly of claim 17, wherein said mating member is a ratchet strap comprising said first row of securing teeth and a second row of securing teeth.

19. The side-release buckle assembly of claim 18, wherein said first row and said second row of securing teeth are configured to move over said first and second latches in a first direction and prevented from retreating in a second direction opposite to the first direction unless said button is pressed.

20. The side-release buckle assembly of claim 17, wherein said main housing further comprises a first web engagement member configured to retain a first web defining a first strap, and wherein said mating member further comprises a second web engagement member configured to retain a second web defining a second strap.

* * * * *